United States Patent [19]

Abys

[11] 4,427,502

[45] Jan. 24, 1984

[54] PLATINUM AND PLATINUM ALLOY ELECTROPLATING BATHS AND PROCESSES

[75] Inventor: Joseph A. Abys, Bridgewater, N.J.

[73] Assignee: Bell Telephone Laboratories, Incorporated, Murray Hill, N.J.

[21] Appl. No.: 321,180

[22] Filed: Nov. 16, 1981

[51] Int. Cl.[3] ..... C25D 3/52; C25D 3/56

[52] U.S. Cl. ..... 204/44; 204/43 N; 204/47

[58] Field of Search ..... 204/47, 43 N, 44, 109, 204/123

[56] References Cited

U.S. PATENT DOCUMENTS

| | | | |
|---|---|---|---|
| 2,355,070 | 8/1944 | Harford | 204/52 R |
| 2,384,300 | 9/1945 | Harford | 204/55 R |
| 4,153,523 | 5/1979 | Koontz et al. | 204/129.6 |
| 4,230,538 | 10/1980 | Turner | 204/15 |

FOREIGN PATENT DOCUMENTS

| | | | |
|---|---|---|---|
| 1182924 | 12/1964 | Fed. Rep. of Germany | 204/47 |

OTHER PUBLICATIONS

A. Brenner, "Electrodeposition of Alloys", vol. II, pp. 542–546, (1963).

F. A. Lowenheim, "Electroplating", pp. 298–300, (1978).

Edward A. Parker, Metal Finishing, vol. 79, No. 1A, pp. 305–306, (1981).

W. Keitel et al., Trans. Electrochem, Soc., vol. 59, p. 273, (1931).

*Primary Examiner*—G. L. Kaplan

*Attorney, Agent, or Firm*—Walter G. Nilsen

[57] ABSTRACT

A procedure is described for electroplating platinum and platinum alloys. This procedure permits rapid electroplating of platinum and yields platinum films with excellent properties. The electroplating bath comprises a unique platinum complexing agent, namely an organic polyamine compound. The procedure is also useful for electroplating a variety of platinum alloys. In addition, the bath is highly stable and does not adversely affect the base material being plated.

25 Claims, 1 Drawing Figure

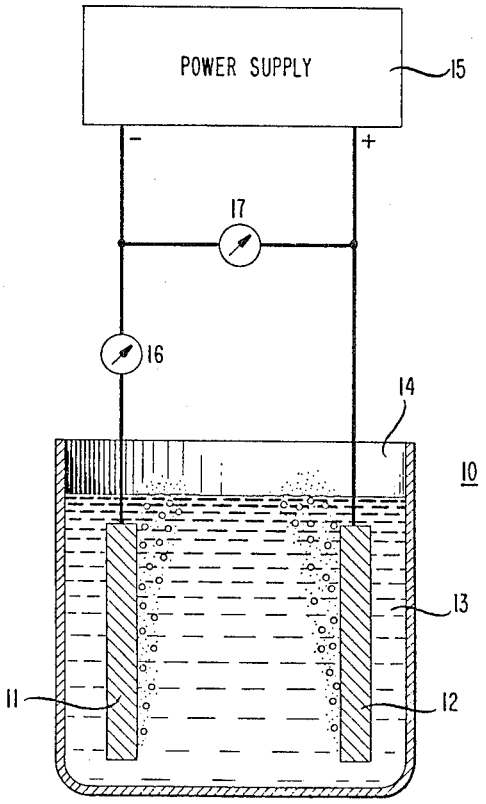
POWER SUPPLY
15
-
+
17
16
14
10
13
11
12

PLATINUM AND PLATINUM ALLOY ELECTROPLATING BATHS AND PROCESSES

TECHNICAL FIELD

The invention is a process for electroplating platinum-containing metallic materials from an aqueous plating bath.

BACKGROUND OF THE INVENTION

Precious metals are used as protective films on surfaces for a variety of reasons. In the jewelry trade, it is used to improve the appearance of an article as in platinum plated jewelry. In other applications, it is used to protect against corrosion of metals and other surface materials. In the electrical arts protective films made of precious metals are used as conduction paths in electrical circuits and as contact surfaces in devices with electrical contacts. Gold is used extensively in these applications with great success. However, other metals are useful in such applications, including platinum because of its different color and possible superior properties for some applications.

Platinum and platinum alloys are used extensively in a variety of industrial applications. Typical examples are the jewelry trade where such films are used to protect surfaces against corrosion and to improve appearance. Platinum films are also used to protect silverware, certain scientific instruments and standard weights. Platinum is also used in the electrical arts in various electrical devices and electronic circuits and in the chemical field for electrodes and catalysts.

Because of chemical inertness and reasonable hardness, platinum is often used as an electrical contact material in electrical connectors, relay contacts, switches, etc. Various platinum alloys such as platinum-rhodium, platinum-silver, platinum-gold and platinum-nickel are also useful for the same applications or other applications.

Highly desirable is a process for plating platinum from an aqueous solution which is rapid and yields platinum and platinum-alloy films which are ductile and adherent. In many applications, it is desirable that the platinum plating bath not chemically attack the surface being plated so that the bath remains uncontaminated during the plating process.

The literature on the electroplating of platinum is not very extensive. A. Brenner has summarized electroplating of platinum metal and alloys (see *Electrodeposition of Alloys, Principles and Practice,* Vol. II, Academic Press, 1963, pp. 542–546). Several platinum electroplating baths are described in a book by F. A. Lowenheim entitled *Electroplating,* McGraw-Hill, 1978, pp. 298–300. Particular baths are also disclosed in *Metal Finishing,* published by Metals and Plastics Publications, Inc., Vol. 79, No. 1A (1981) pp. 305–306. An electroplating bath for platinum is also described by W. Keitel and H. E. Zschiegner in *Transactions of the Electrochemical Society,* Vol. 59, page 273 (1931).

SUMMARY OF THE INVENTION

The invention is a process for electroplating platinum (both pure metal and alloys with various metals) from an aqueous plating solution in which the plating solution comprises platinum in the form of a complex ion and the complexing agent is one or more organic aliphatic polyamines with from 3 to 20 carbon atoms. Both straight chain and branch chain aliphatic groups may be attached to the amine groups. Typical complexing agents are diaminopropane (particularly 1,3-diaminopropane), diethylenetriamine, 1,4-diaminobutane, 1,6-diaminohexane, etc. Secondary polyamines such as N,N'dimethyl-1,3-propanediamine and tertiary polyamines such as N,N,N'N'tetramethylethylenediamine are also useful provided the total number of carbon atoms does not exceed 20. A limited number of substituents are also useful, such as hydroxy groups (i.e., 2-hydroxy-1,3-diaminopropane) and halogen groups such as chloride and bromide. It is preferred that the aqueous electroplating bath be alkaline (pH greater than 7.0) to avoid corrosion of the surface being plated and sufficiently conductive to allow plating (generally greater than $10^{-3}$ mho-cm). Additional substances may be added to the platinum electroplating bath to control and adjust pH (such as a buffer), to increase conductivity and to improve the properties of the plated metal. Typical substances used to improve the plated metal are lactones (i.e., phenolphthalein, phenolsulfone-phthalein, etc.), lactams, cyclic sulfate esters, cyclic imides and cyclic oxazolinones. Certain polyalkoxylated alkylphenols may also be useful. The process is also useful for plating certain platinum alloys including 10 mole percent platinum, remainder copper, cobalt, nickel, gold, palladium, rhodium, ruthenium, and/or silver.

BRIEF DESCRIPTION OF THE DRAWING

The FIGURE shows a typical apparatus useful in electroplating platinum and platinum alloys in accordance with the invention.

DETAILED DESCRIPTION

The invention is a process for electroplating platinum metal or platinum alloy in which a certain class of organic aliphatic polyamines is used as complexing agent in the platinum plating bath. Most useful are aliphatic polyamines with from 3 to 20 carbon atoms. Complexing agents with less than 3 carbon atoms yield useful results but tend to evaporate and limit the lifetime of the bath. Complexing agents with more than 20 carbon atoms usually have limited solubility in aqueous solutions. Aromatic polyamines are also useful but often are difficult to work with (often poisonous with undesirable odor). Most preferred are the complexing agents 1,3-diaminopropane and diethylenetriamine because of the excellent quality of the platinum plating obtained, especially at high plating current density (greater than about 50 ASF). In addition, the conditions (pH, temperature, etc.) under which optimum plating occurs with these preferred complexing agents permits rapid plating with excellent plating results in terms of ductility of the plated film, adherence of the plated film, etc. Also, undesirable chemical attack on the surface being plated is minimal or insignificant under optimum conditions of plating with these complexing agents.

Within the limitations set forth above, the structure of the complexing agent may vary considerably. In particular, these complexing agents may contain certain substituents which do not significantly alter their complexing properties but may increase solubility, stability, electrochemical reduction (or oxidation) potential, etc. Typical substituents are hydroxyl groups, chloride and bromide. The complexing agents should be stable to the conditions of the electroplating process and in particular not undergo oxidation or reduction under the conditions of the electroplating process. For example, carboxylic acid groups should be avoided because such substituted aliphatic polyamines are generally not electrochemically stable. Often the choice of a particular polyamine complexing agent depends on electrochemical stability.

Alloy plating may also be carried out using the polyamine complexing agent. Typical elements alloyed with platinum are silver, copper, nickel, cobalt, iron, gold, chromium, manganese, ruthenium, rhodium and iridium. Particularly useful are copper, cobalt, nickel, palladium, rhodium, ruthenium and silver. Preferred are alloys comprising at least 10 mole percent platinum, remainder copper, cobalt, palladium, rhodium, ruthenium, silver and/or nickel. Other useful alloys are 60 mole percent platinum, remainder silver, copper and/or nickel, 40 mole percent platinum, remainder silver, copper and/or nickel, etc.

A large variety of counter ions (anions) may be used in the electroplating bath provided the anions are stable (chemically and electrochemically) and in particular are not subject to oxidation or reduction under conditions of the electroplating process. In addition, the anion should not interfere with the plating process by either chemical attack on the surface being plated or on the metal complex system. Typical anions are halides, nitrate, sulfate and phosphates. Chloride ion is preferred because of the low cost of availability of platinum chloride and the stability of the chloride ion under conditions of the electroplating process. Also, certain ions, including those set forth above, may be used as supporting electrolyte to increase conductivity of the electroplating bath. The cation used for the supporting electrolyte may be any soluble ion which does not interfere with the electroplating process. Alkali-metal ions (Na, K, Li) are particularly preferred because of solubility and stability.

Various compounds may be used as a source of platinum. Typical compounds are $K_2PtCl_4$, $PtCl_2$, $PtBr_2$, $K_2PtBr_4$, $K_2Pt(NO_2)_4$ and $Pt(NO_3)_2$. Platinum chloride is preferred because of availability and stability. These compounds may be used initially to make the bath and to replenish the bath. Also of interest is the use of the oxide or hydroxide of platinum in such a way that no anion (other than hydroxide ion) is added to the bath. Such a procedure could be used either as an initial charge for the bath or in replenishing the electroplating bath.

Particular advantages of the electroplating bath using organic aliphatic polyamines as complexing agent are the improved conditions of plating which reduce chemical attack on the surface being plated and improve the quality of plating even at very high plating rates. For example, the pH of the bath may vary over large limits, but generally alkaline aqueous solution is preferred (typically pH from 7.5 to 13.0) with the range from 10.0 to 12.5 most preferred. With too high a pH, the plated platinum might become dull, possibly because of the appearance of the oxide. Too low a pH (particularly below 7.5), the platinum complex might be unstable. The preference particularly applies when the preferred polyamines are used, namely 1,3-diaminopropane and diethylenetriamine. Within the pH range, very rapid plating can be carried out with excellent plating results. Generally, a bath composition which permits rapid plating with more alkaline solution is preferred (up to about pH of 12.5) because of decreased attack on the surface being plated.

The plating process may be carried out with or without a buffer system. A buffer system is often preferred because it maintains constant pH and adds to the conductivity of the bath. Typical buffer systems are the phosphate system, borax, bicarbonate, etc. Preferred is the $HPO_4^{-2}/PO_4^{-3}$ system often made by adding an alkali-metal hydroxide (KOH, NaOH, etc.) to an aqueous solution of the hydrogen phosphate ion. Generally, the concentration of buffer varies from about 0.1 Molar to 2 Molar (about 1.0±0.2 Molar preferred) and the mole ratio of hydrogen phosphate to phosphate varies from 5/1 to 1/5 (with equal mole amounts within ±50 percent preferred). These mole ratios often depend on the particular pH desired for the plating bath.

The bath temperature may vary over large limits, typically from the freezing point to the boiling point of the electroplating bath. Often, the preferred plating temperature range depends on bath composition and concentration, plating cell design, pH and plating rate. Preferred temperatures for typical conditions are from room temperature to about 90 degrees C. Preferred temperature is from 50 to 70 degrees C.

Various surfaces may be plated using the disclosed process. Usually, the plating would be carried out on a metal surface or alloy surface, but any conducting surface would appear sufficient. Also, electrolessly plated surfaces may be useful. Typical metal and alloy surfaces are copper, nickel, gold, palladium, platinum, (as, for example, a surface electrolessly plated with platinum and then electroplated with platinum in accordance with the invention). Various alloy surfaces may also be used such as copper-nickel-tin alloys.

The composition of the bath may vary over large limits provided it contains a source of platinum and significant amounts of one or more polyamines of the class set forth above. In general, sufficient polyamine should be present to complex with the platinum. Usually, it is advantageous if excess polyamine is present in the bath solution.

The platinum concentration in the bath typically varies from 0.005 Molar to saturation. Preferred concentrations often depend on plating rate, cell geometry, agitation, etc. Typical preferred platinum concentration ranges for high-speed plating (50 to 1000 ASF) are higher than for low-speed plating (up to 50 ASF). Preferred platinum concentration ranges for high-speed plating vary from 0.1 to 1.0 Molar. For low-speed plating, the preferred range is from 0.01 to 0.3 Molar. Where platinum alloy plating is included, the alloy metal (usually copper, gold, rhodium, silver or nickel) replaces part of the platinum in the composition of the plating bath. Up to 90 mole percent of platinum may be replaced by alloy metal.

The amount of complexing agent (polyamine) may vary over large limits, typically from 0.5 times (on the basis of moles) the concentration of the platinum species to saturation of the complexing agent. Generally, it is preferred to have excess complexing agent, typically from two times to six times the mole concentration of the species. Most preferred is about three to six times the mole concentration of platinum. The preferred ranges of complexing agent in terms of platinum species are the same for high-speed and low-speed baths.

The concentration of buffer may vary over large limits. Such concentrations often depend on cell design, plating rates, etc. Typically, the buffer concentration varies from 0.1 Molar to saturation with from 0.2 to 2.0 Molar preferred. Rapid agitation is usually preferred, especially where high plating rates are used. Various procedures may be used to achieve rapid agitation, including stirring, rapid circulation of the electroplating bath past the plating electrodes, spraying of bath onto the electrodes, etc.

The bath may be prepared in a variety of ways well known in the art. A typical preparation procedure which yields excellent results is set forth below: Equal volumes (51 mls) of 1,3-diaminopropane and water are mixed in a beaker. Heat of solution is sufficient to heat the resulting solution to about 60 degrees C. To this solution with vigorous stirring are added 40 gms of $K_2PtCl_4$ in portions approximately of 0.5 gms every two minutes. The solution is filtered to remove solid matter (generally undissolved platinum salt) and diluted to one liter.

To this solution are added one mole of $K_2HPO_4$ and sufficient KOH to adjust the pH to a value of 11.5 at 25 degrees C. The pH can be adjusted upward by the addition of KOH and downward by the addition of $H_3PO_4$.

Electroplating experiments are carried out in an electroplating cell provided with means for high agitation. Temperature is maintained at about 60 degrees C. Current is passed through anode, electroplating bath and cathode. The electrical energy is supplied by a conventional power supply. The current density is 50 ma/cm$^2$ and 100 ma/cm$^2$. Typical thicknesses in these experiments are 40 to 150 microinches. The deposit is crack-free as determined by optical microscopy examination. Both adherence and ductility are excellent and the plated surface is bright and shiny. Plating rate is often determined by the thickness desired after a predetermined period of plating. For example, in a strip line plating apparatus (see, for example, U.S. Pat. No. 4,153,523 issued to D. E. Koontz and D. R. Turner on May 8, 1979 and U.S. Pat. No. 4,230,538 issued to D. R. Turner on Oct. 28, 1980) the strip line being plated is exposed to the plating solution for a set period of time (depending on the speed the strip is moving down the line and the length of the plating cell) and the plating rate is adjusted to give the desired thickness in this period of time. Similar results are obtained with diethylenetriamine. Experiments carried out with 2 hydroxypropanediamine, 1,4-diaminobutane, 1,5-diaminopentane and 1,6-diaminohexane yield similar results.

Similar results are obtained with low-speed baths. Here the preparation procedure is exactly the same except the quantity of reagents are different. A typical bath contains 25 gms $PtCl_2$, 42 gms polyamine complexing agent, 42 gms $K_3PO_4$, 139 gms $K_2HPO_4$ and sufficient water to make one liter. The preparation procedure is exactly the same as above. The pH is about 10.8 at 55 degrees C. and plating is carried out in the temperature range from 50 to 65 degrees C. Typical slow plating rates are about 10 ASF.

Similar experiments were carried out on the following bath compositions:

EXAMPLE 1

20.0 gm/l $PtCl_2$, 15.5 gm/l diethylenetriamine and phosphate buffer. Electroplating is carried out at 55 degrees C. on a copper substrate.

EXAMPLE 2

10.0 gm/l $PtCl_2$, 12.0 gm/l 1,6-hexadiamine and phosphate buffer. Electroplating is carried out at 55 degrees C. on a copper substrate.

EXAMPLE 3

10.0 gm/l $Pt(NO_3)_2$, 12.0 gm/l 1,6-hexadiamine and phosphate buffer. Electroplating is carried out at 55 degrees C. on a copper substrate.

EXAMPLE 4

18.0 gm/l $PtCl_2$, 18.0 gm/l 1,4-butadiamine and phosphate buffer. Same as above.

EXAMPLE 5

0.05 Molar $Pt(NO_3)_2$, 0.1 Molar diethylenetriamine, no buffer, 0.4 Molar $KNO_3$. The pH is varied by the addition of KOH from 10 to 14, temperature from 20 degrees C. to 70 degrees C.

EXAMPLE 6

0.1201 Molar $Pt(NO_3)_2$, 3.2 Molar diethylenetriamine, 0.5 Molar $KNO_3$, no buffer. The pH is varied from 12 to 14 by addition of NaOH. Temperature is about 65 degrees C.

EXAMPLE 7

0.02097 Molar $PtSO_4.2H_2O$, 0.1 Molar diethylenetriamine, 0.419 Molar $Na_2SO_4$. The pH range was varied from 10.2 to 13.5 by addition of NaOH, temperature varied from 20 degrees C. to 70 degrees C.

EXAMPLE 8

0.052 Molar $PtCl_2$, 0.4 Molar 1,4-diaminobutane, $Na_2SO_4$ and NaCl as supporting electrolyte, no buffer. Electroplated at 43 ASF to 138 microinches on copper. Deposit is bright and adherent. Repeat as 65 ASF to 138 microinches.

Platinum alloys may also be electroplated in accordance with the invention. A typical bath composition for platinum alloy plating is as follows: 69.6 gms $Ag_2O$, 53.2 gms $PtCl_2$, 222 gms 1,3-diaminopropane, 106.2 gms $K_3PO_4$, 86.5 gms $K_2HPO_4$ and water to one liter. The pH of the bath is adjusted to 11.3 by the addition of KOH or $H_3PO_4$. The bath temperature is maintained between 40 and 65 degrees C. and current density between 1 and 500 ASF. The other polyamine complexing agents mentioned above are also useful, including diethylenetriamine. A useful bath for platinum-nickel plating is as follows: 38.9 gms $NiCl_2$, 53.2 gms $PtCl_2$, 222 gms 1,3-diaminopropane, 106 gms $K_3PO_4$, 86.5 gms $K_2HPO_4$ and water to one liter. Preferred operating temperature is from 40 to 65 degrees C., pH is about 12 and current density from 1 to 500 ASF. Similar results are obtained with a platinum-cobalt bath.

The apparatus described in the above-cited patents are particularly advantageous for carrying out the process. They permit good control of the bath conditions, the rate of plating and permit rapid platinum plating. The platinum plating process is highly advantageous for plating electrical contact pins for electrical connectors such as described in the above references.

FIG. 1 shows apparatus 10 useful in the practice of the invention. The surface to be plated 11 is made the cathode in the electrolytic process. The anode 12 is conveniently made of platinized titanium or may be made of various other materials such as oxides of platinum group metals, binder metal oxides, etc. Both anode and cathode are partially immersed in the electroplating bath 13 containing source of platinum complex with an organic aliphatic polyamine. A container is used to hold the platinum plating solution and the anode 12 and cathode 11 are electrically connected to source of electrical energy 15. An ammeter 16 and voltmeter 17 are used to monitor current and voltage. The voltage and current are controlled inside the source of electrical energy 15.

What is claimed is:

1. A process for electroplating a metallic substance on a surface, said metallic substance comprising platinum, comprising the step of passing current through a cathode, an electroplating bath and an anode with cathode potential great enough to electroplate platinum, said electrochemical bath having conductivity greater than $10^{-3}$ mho-cm and pH greater than 7 characterized in that the electroplating bath comprises an aqueous solution of platinum-aliphatic polyamide complex in which the aliphatic polyamine has from 3 to 20 carbon atoms and substituents are selected from the group consisting of hydrogen, hydroxide, chloride and bromide, the concentration of platinum-aliphatic polyamine complex is between 0.005 molar and saturation and the platinum in the platinum-aliphatic polyamine complex is in a divalent state.

2. The process of claim 1 in which at least 90 mole percent of the metallic substance consists of an alloy, said alloy consisting of at least 10 mole percent platinum, remainder at least one metal selected from the group consisting of silver, copper, nickel, cobalt, gold, ruthenium, rhodium and iridium.

3. The process of claim 1 in which the metallic substance consists essentially of platinum.

4. The process of claim 1 in which the substituent is hydrogen.

5. The process of claim 4 in which the aliphatic polyamine is selected from the group consisting of 1,3-diaminopropane and diethylenetriamine.

6. The process of claim 5 in which the pH varies from 7.5 to 13.0.

7. The process of claim 6 in which the pH varies from 10.0 to 12.5.

8. The process of claim 6 in which the electroplating bath comprises a buffer.

9. The process of claim 8 in which the buffer comprises hydrogen phosphate ion and phosphate ion.

10. The process of claim 9 in which the buffer concentration varies from 0.1 to 2 Molar and the ratio of hydrogen phosphate to phosphate ion varies from 5/1 to 1/5.

11. The process of claim 1 in which the electroplating process is carried out at a temperature between room temperature and 90 degrees C.

12. The process of claim 11 in which the temperature is between 50 and 70 degrees C.

13. The process of claim 1 in which the concentration of platinum is from 0.01 to 1.0 Molar.

14. The process of claim 1 in which the concentration of aliphatic polyamine is from 0.5 times the concentration of platinum to saturation of the aliphatic polyamine.

15. The process of claim 14 in which the concentration of aliphatic polyamine is from two to 12 times the mole concentration of platinum.

16. The process of claim 1 in which the plating current density is between 50 and 1000 ASF.

17. The process of claim 1 in which the platinum in the electroplating bath is replenished by the addition of a source of platinum.

18. The process of claim 17 in which the source of platinum is platinum chloride.

19. The process of claim 17 in which the source of platinum is a source of tetrachloroplatinate ion.

20. The process of claim 1 in which the plating current density is up to 50 ASF.

21. A process for electroplating a metallic substance on a surface, said metallic substance comprising platinum comprising the step of passing current through a cathode, an electroplating bath and an anode with a cathode potential great enough to electroplate platinum, said electrochemical bath having conductivity greater than $10^{-3}$ mho-cm and pH greater than 7 characterized in that the electrochemical bath comprises an aqueous solution of platinum-aliphatic polyamine complex, said complex the same as results from reacting a source of platinum with an aliphatic polyamine with from 3 to 20 carbon atoms and at least one substituent selected from the group consisting of hydrogen, hydroxide, chlorine and bromine, the concentration of platinum-aliphatic polyamine complex is between 0.005 molar and saturation and the platinum in the platinum-aliphatic polyamine complex is in a divalent state.

22. The process of claim 21 in which the source of platinum is platinum chloride.

23. The process of claim 21 in which the source of platinum is alkali-metal tetrachloroplatinate.

24. The process of claim 21 in which the substituent is hydrogen.

25. The process of claim 21 in which the aliphatic polyamine is selected from the group consisting of 1,3-diaminopropane and diethylenetriamine.

* * * * *

UNITED STATES PATENT AND TRADEMARK OFFICE

CERTIFICATE OF CORRECTION

PATENT NO. : 4,427,502

DATED : January 24, 1984

INVENTOR(S) : Joseph A. Abys

It is certified that error appears in the above-identified patent and that said Letters Patent is hereby corrected as shown below:

Column 6, line 24, "$PtSO_4.2H_2O$" should read --$PtSO_4 \cdot 2H_2O$--.

Column 7, line 17, "polyamide" should read --polyamine--.

Signed and Sealed this

*Twenty-fourth* Day of *April 1984*

[SEAL]

*Attest:*

GERALD J. MOSSINGHOFF

*Attesting Officer*

*Commissioner of Patents and Trademarks*